United States Patent [19]

Murley et al.

[11] Patent Number: 4,775,426

[45] Date of Patent: Oct. 4, 1988

[54] METHOD OF MANUFACTURING SURGICAL IMPLANTS FROM CAST STAINLESS STEEL AND PRODUCT

[75] Inventors: John Murley, Memphis; Bob Wigginton, Collierville; Imogene Baswell, Memphis, all of Tenn.

[73] Assignee: Richards Medical Company, Memphis, Tenn.

[21] Appl. No.: 847,929

[22] Filed: Apr. 3, 1986

[51] Int. Cl.[4] ..... C21D 7/02

[52] U.S. Cl. ..... 148/2; 29/527.5; 72/377; 148/12 E; 148/327; 623/16

[58] Field of Search ..... 148/2, 12 E, 38, 327; 29/527.5; 72/377; 623/16, 901

[56] References Cited

U.S. PATENT DOCUMENTS

| | | | |
|---|---|---|---|
| 2,358,799 | 9/1944 | Franks | 148/12 E |
| 2,871,557 | 2/1959 | Tarmann et al. | 29/527.5 |
| 3,197,997 | 8/1965 | Kurtz | 72/377 |
| 3,284,250 | 11/1966 | Yeo et al. | 148/12 E |
| 3,340,048 | 9/1967 | Floreen | 148/327 |
| 3,399,560 | 9/1968 | Connolly et al. | 72/368 |
| 3,645,124 | 2/1972 | Rohrabaugh | 72/377 |
| 3,737,981 | 6/1973 | Plockinger et al. | 29/527.5 |
| 3,740,274 | 6/1973 | Chow | 148/12 E |
| 3,821,843 | 7/1974 | Medrick et al. | 148/2 |
| 3,871,925 | 3/1975 | Nunes | 148/12 E |
| 4,253,323 | 3/1981 | Murakami et al. | 72/377 |

OTHER PUBLICATIONS

Handbook of Stainless Steels, Chapters 10 and 42, Donald Peckner, McGraw-Hill Book Company.

ASTM Designation F138-82, pp. 32-35.

ASTM Designation F 745-81, pp. 270-273.

Metallography Principles and Practice, G. F. VanderVoort, McGraw-Hill Book Company, 1984 ed, pp. 355-366.

"Pitting Resistance of New & Conventional Orthopedic Implant Materials—Effect of Metallurgical Condition"; by Barry C. Syrett and Sharon S. Wing; *Corrosion,* vol. 34, No. 4, pp. 138-145; Apr. 1978.

"Influence of Cold Plastic Deformation on Critical Pitting Potential of AISI 316 L and 304 L Steels in an Artificial Physiological Solution Simulating the Agressiveness of the Human Body"; by Cigada, Mazza, Pedeferri and Sinigaglia; *J. Biomed. Mater. Res.;* vol. II, pp. 503-512; 1977.

"The Three-Way Tradeoff in Stainless-Steel Selection"; by Robert S. Brown; *Journal of Mechanical Engineering,* pp. 58-62; Nov. 1982.

"Improved Properties of Type 316L Stainless Steel Implants by Low-Temperature Stress Relief"; by Hockman and Taussig; *Journal of Materials,* vol. 1, No. 2, pp. 425-442; Jun. 1966.

"How Corrosion Fatigue Strength of Nickel-Containing Materials Relates to Ultimate Tensile Strength and Other Factors"; Nickel Topics; vol. 3, No. 3, pp. 8-10 (1978).

"Surface Preparation and Corrosion Behavior of Titanium Alloys for Surgical Implants"; Fraker, Ruff, Sung, VanOrden and Speck; *Titanium Alloys in Surgical Implants,* ASTM STP, pp. 206-219; 1983.

"The Comparative Crevice Corrosion Resistance of Co-Cr Base Surgical Implant Alloys"; Devine and Wulff; *J. Electrochem. Soc.: Electrochemical Science and Technology,* pp. 1433-1437, vol. 123, No. 10, Oct. 1976.

"Corrosion Fatigue of 316L Stainless Steel, Co-Cr-Mo Alloy, and ELI Ti-6A1-4V"; by Imam, Fraker and Gilmore; *Corrosion and Degradation of Implant Materials,* ASTM STP 684, pp. 128-143; 1979.

"Corrosion Behaviour of Cast and Forged Implant Materials for Artificial Joints, Particularly with Respect to Compound Designs"; by P. Sury; Sulzer Research Number 1974; pp. 1-12; 1974.

*Primary Examiner*—R. Dean

*Attorney, Agent, or Firm*—Pravel, Gambrell, Hewitt, Kimball & Krieger

[57] ABSTRACT

A surgical implant is disclosed manufactured from cast austenitic stainless steel and cold-forged to a final shape. The endoprosthesis is initially a preform which is cast oversized in shape and dimensions. It is then compressed using the cold-forging process to its final size and shape. Using a cast material as a starting material and then compressing it substantially reduces the porosity of the material and increases its strength compared to a machined product from a wrought material.

21 Claims, 5 Drawing Sheets

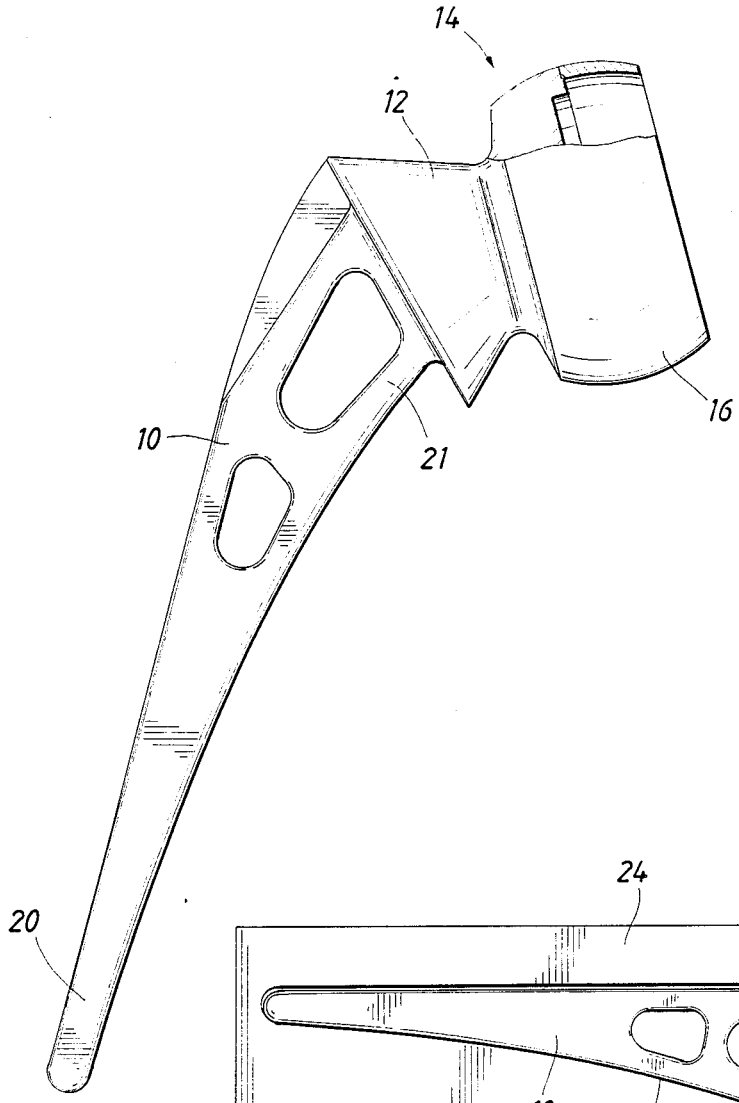
FIG. 1
FIG. 2A
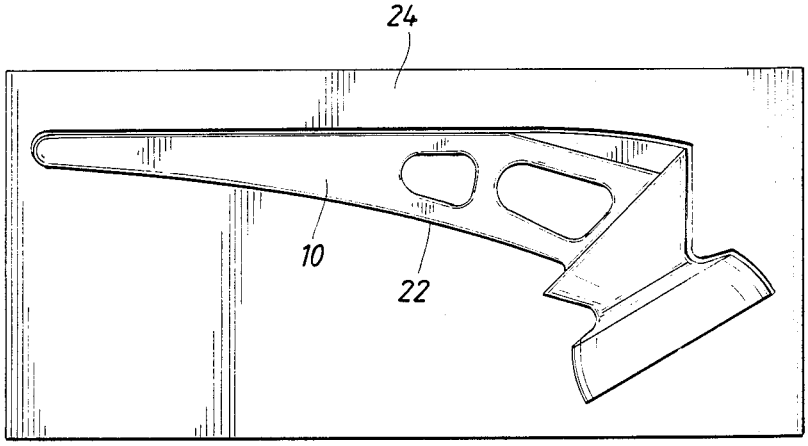
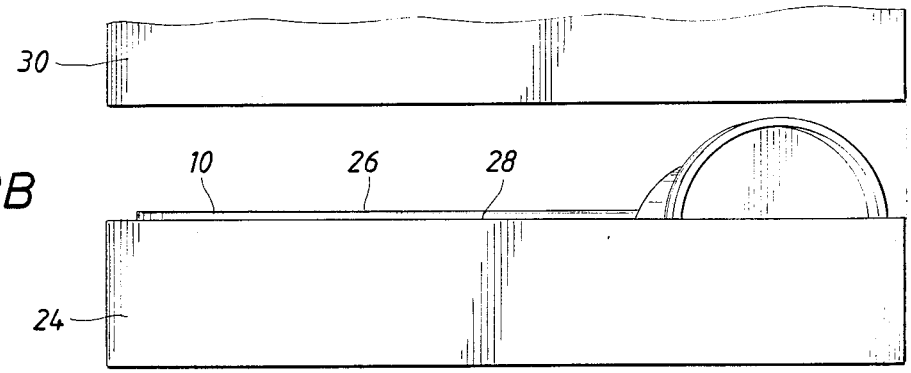
FIG. 2B

FIG. 3B
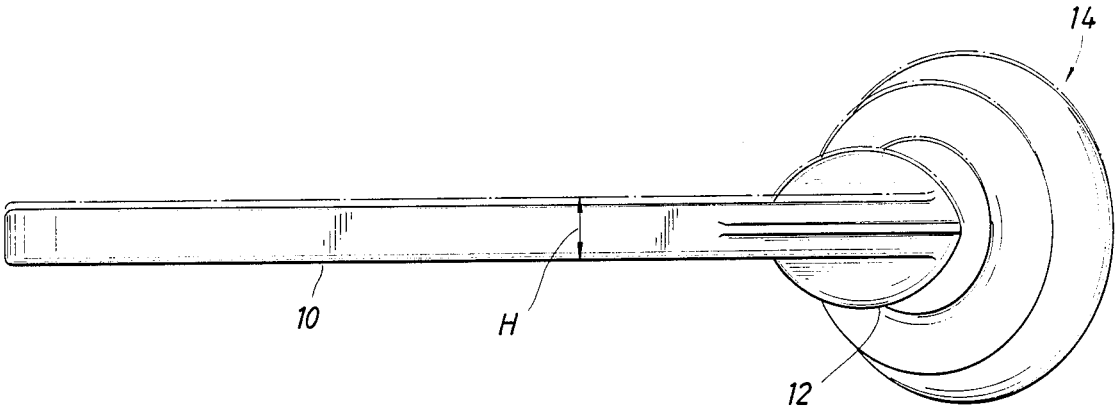
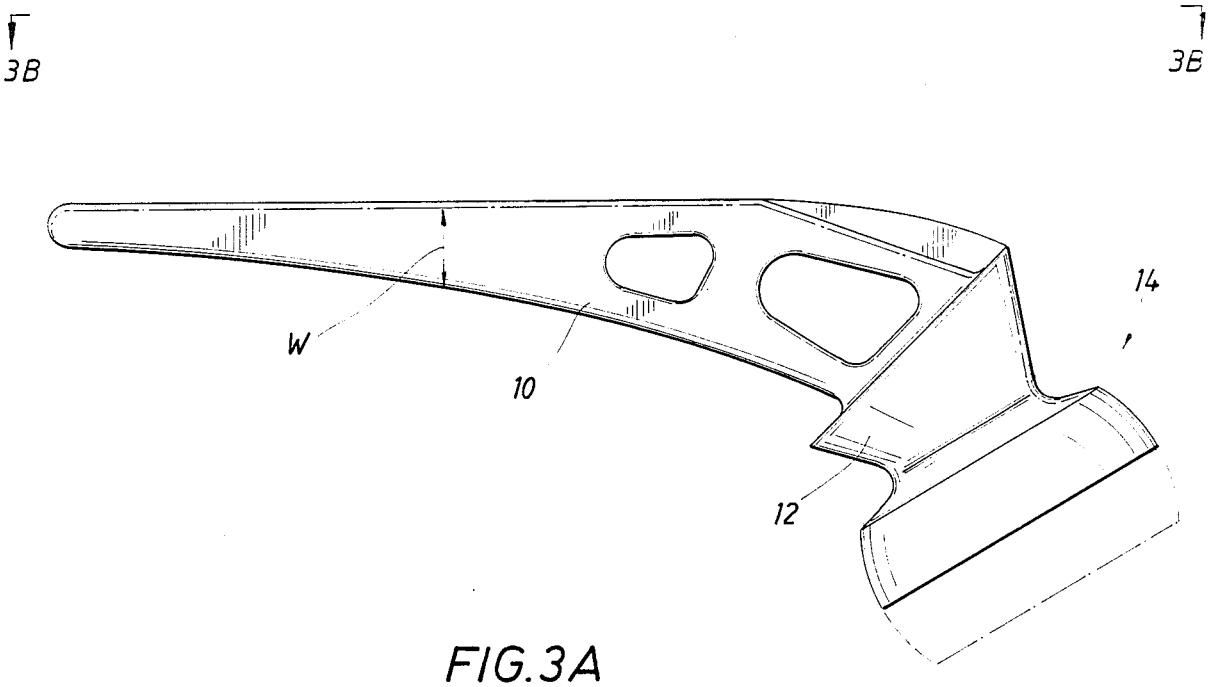
FIG. 3A

FIG.6 TENSILE STRENGTH VS. PERCENT REDUCTION — ×
YIELD STRENGTH VS. PERCENT REDUCTION — ⊙
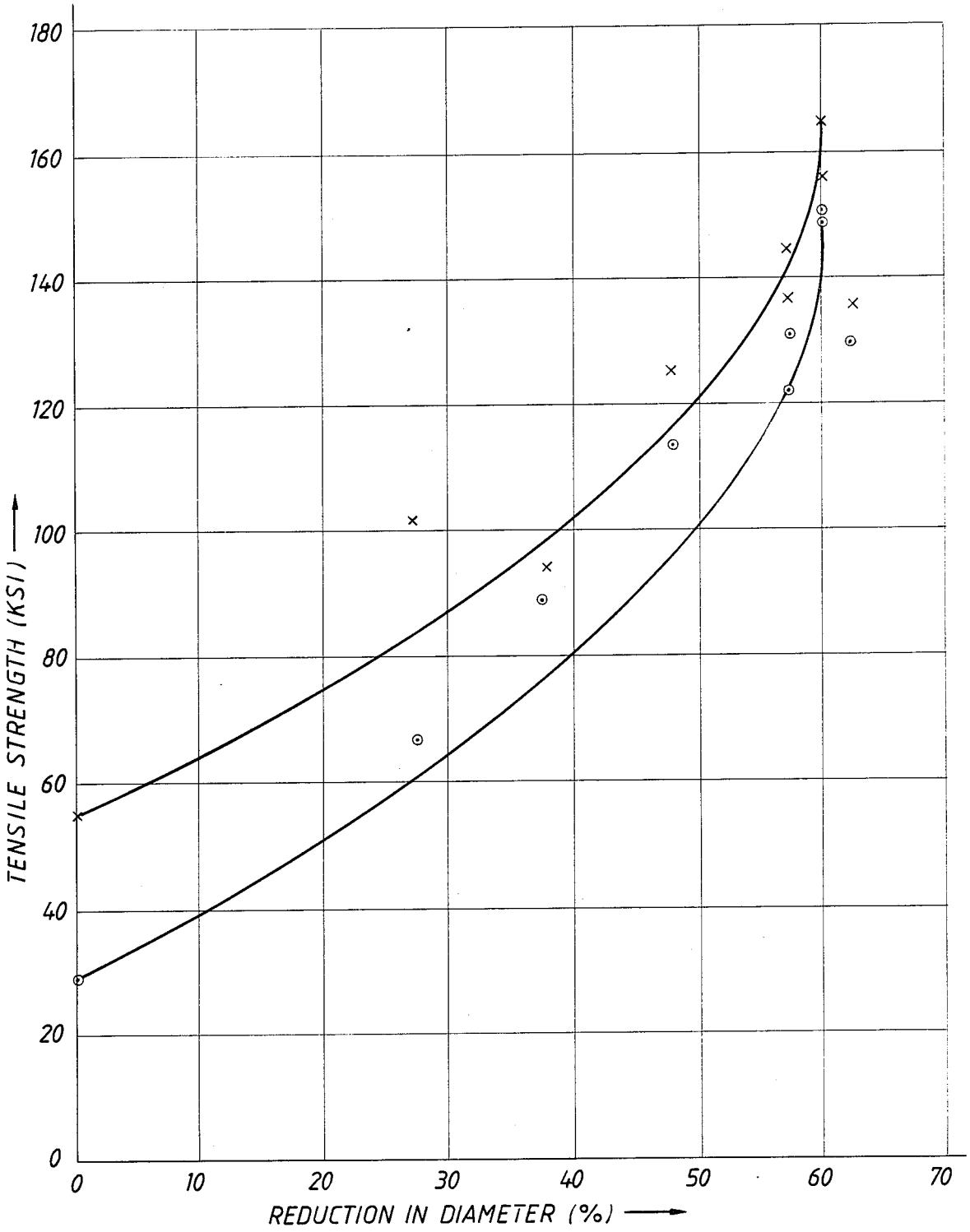

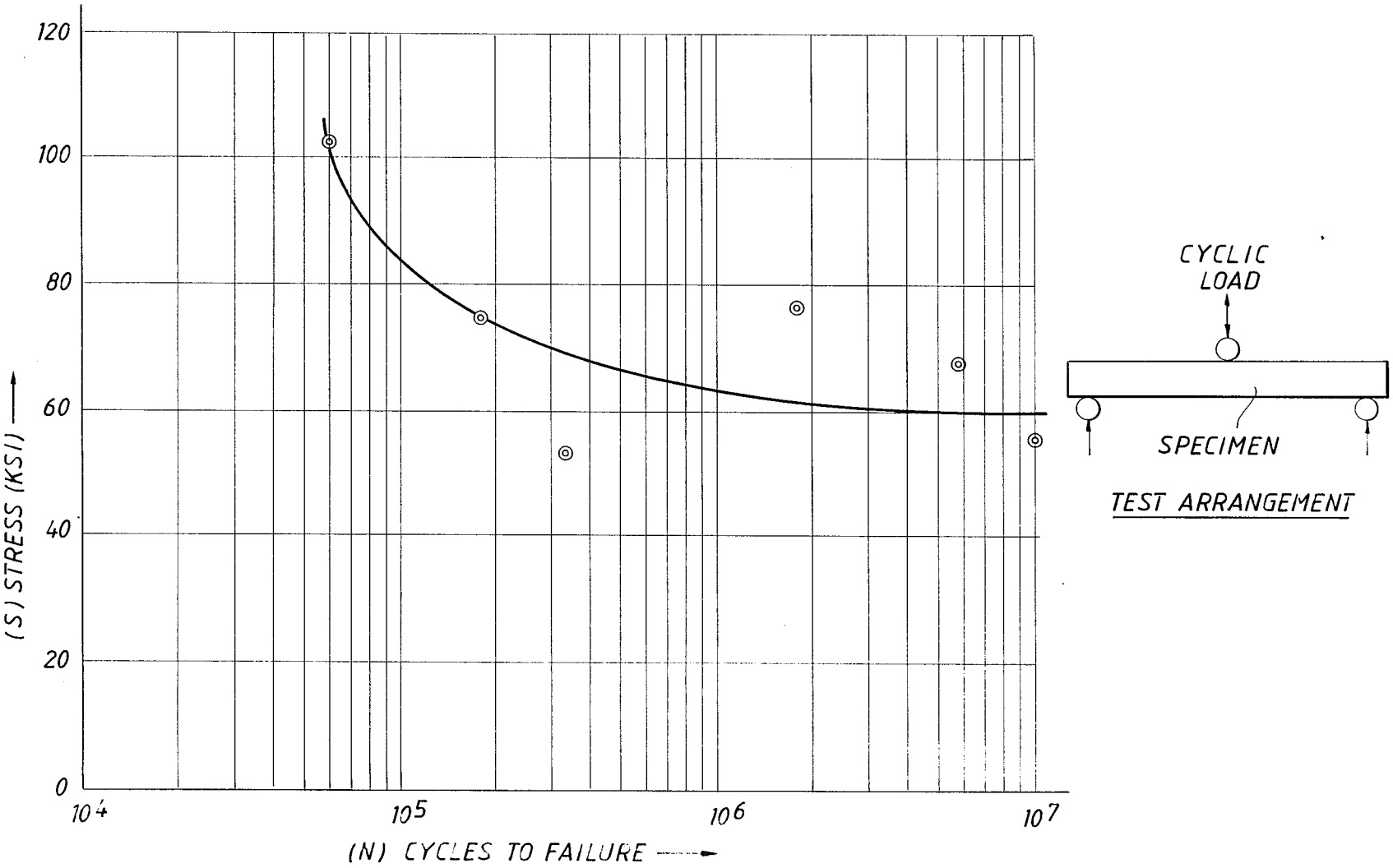
FIG. 7 CORROSION FATIGUE CURVE FOR CCF STAINLESS STEEL (R=0.1)

METHOD OF MANUFACTURING SURGICAL IMPLANTS FROM CAST STAINLESS STEEL AND PRODUCT

BACKGROUND OF THE INVENTION

The invention relates to surgical implants and, more particularly, to a method of manufacturing such implants from surgical grade austenitic stainless steel of the Fe-Cr-Ni type such as type 316L stainless steel.

Among the biocompatible alloys commonly used for surgical implants are titanium alloys, cobalt-chromium-molybdenum alloys, cobalt-chromium-tungsten-nickel, and nominally austenitic stainless steels of iron, chromium and nickel compositions. Of these materials, austenitic stainless steel is the most workable and least expensive starting material. The nominally austenitic Fe-Cr-Ni type is rendered corrosion resistant by surface passivation. Due to its work hardening ability and corrosion resistance, the Fe-Cr-Ni type stainless steel is particularly suitable for load bearing implants in the generally saline environment of the human body.

Many prosthetic devices such as hip prostheses must be formed to exacting size and shape specifications to fit the internal dimensions of the human bones. The austenitic stainless steels, because of their mechanical workability, are particularly advantageous for manufacturing these devices. In the past, prosthetic devices formed of austenitic stainless steel have been formed by heating the material to a high temperature such as 1750° F. then hot forging to a final shape in a mold or machining it from a large block of material to a final shape and size. Heating austenitic stainless steel, however, results in a lower strength partly because the heat erases any cold-work that may be present.

Austenitic stainless steels are cold-worked to increase their mechanical strength. The cold-worked material is then used as a starting material for the manufacture of surgical implants. Additional strength improvement has been reported for one of the austenitic steels, namely Type 316L, by subjecting the cold-worked steel to a low temperature stress relief process, as discussed in "Improved Properties of Type 316L Stainless Steel Implants by Low-Temperature Stress Relief," by Hochman, et al, *Journal of Materials* at 425–442 (1966). The Hochman, et al article reports improvements in hardness, tensile strength, and yield strength by stress relieving cold-worked specimens of Type 316L stainless steel at temperatures of about 750° F. (399° C.) for approximately two hours. Although some improvement in mechanical strength of the cold-worked starting material has been achieved by this stress-relief technique, as reported by Hochman, the corrosion fatigue resistance of the stress-relieved starting material is not affected by such stress relieving.

It has also been reported that cold-working austenitic stainless steels reduces their corrosion resistance and therefore makes them more susceptible to pitting and corrosion fatigue in the generally saline environment of the human body. See, e.g. A. Cigada, et al, "Influence of Cold Plastic Deformation on Critical Pitting Potential of AISI 316L Steels in an Artificial Physiological Solution Simulating the Aggressiveness of the Human Body," *J. Biomed. Mater. Res.* 503 (1977); R. S. Brown, "The Three-Way Tradeoff in Stainless-Steel Selection," *Journal of Mechanical Engineering*, p. 59 (November, 1982); and B. Syrett, et al, "Pitting Resistance of New and Conventional Orthopedic Implant Materials—Effect of Metallurgical Corrosion," Vol. 34, No. 4, pp. 138–145 at p. 144 (April 1978). The conclusions appear to be based on corrosion tests of samples of the starting material which has been nominally cold-worked for the purpose of improving its tensile strength over that of the annealed starting material. However, as discussed below, data obtained regarding the life of an endoprosthesis manufactured in accordance with the present invention indicates improved performance even in a corrosive enviornment.

Casting the starting material has been considered in the past because it is less labor intensive and less expensive. But this option has been dismissed because cast material does not have suitable strength since the casting process results in a relatively porous material compared to a wrought material.

It is therefore desirable to provide a method for transforming a cast stainless steel implant into a finished device of suitable strength and corrosion resistance for use as a surgical implant. Such a method would provide implants with adequate properties that are cost effective for the elderly and less active patients.

SUMMARY OF THE INVENTION

The present invention involves a method of forming a surgical implant from stainless steel that solves the problems discussed above by casting the steel into a predetermined configuration and thereafter cold-pressing (or cold-forging) the configuration to reduce its overall size and shape to the desired finished dimensions. More particularly, the method includes casting a stainless steel starting material (also referred to as a preform). At least a portion of the preform is cast between about 20 and 30 percent larger than the desired final size using conventional casting techniques such as the investment casting technique (also known as the "lost wax method"). The preform is then subjected to the cold-forging technique of the instant invention wherein the preform is forged at ambient temperature in closed dies having cavities sized and shaped such that the cast steel can be compressed to the finished dimensions. Following casting but before cold-forging, the preform may be solution annealed for homogenization of the elements.

It has been found that the resulting finished implant has a 40 percent or more increase in ultimate tensile stress and over 125 percent increase in yield stress compared to the cast preform before cold-forging.

Moreover, after cold-forging, the implant is stress relieved at temperatures of about 750° F. (399° C.) for about two hours. It has been found that such a subsequent residual stress relieving heat treatment produces a part that has enhance corrosion resistance.

BRIEF DESCRIPTION OF THE FIGURES AND TABLES

FIG. 1 is a plan view of a hip prosthesis preform cast in accordance with the first step of the present invention;

FIGS. 2*a* and 2*b* are schematical illustrations of the cold-pressing step of the present invention;

FIGS. 3*a* and 3*b* are horizontal and elevational views, respectively, of the finished hip prosthesis after cold-pressing in accordance with the instant invention, with a portion of the cast preform shown in broken lines;

FIG. 6 is a graph of tensile and yield stresses versus reduction in area of the prostheses which illustrates enhance strength characteristics using the present invention;

FIG. 7 is a graph of stress versus cycles to failure which illustrates the corrosion fatigue characteristics of an endoprosthesis manufactured in accordance with the present invention;

Figure 4:
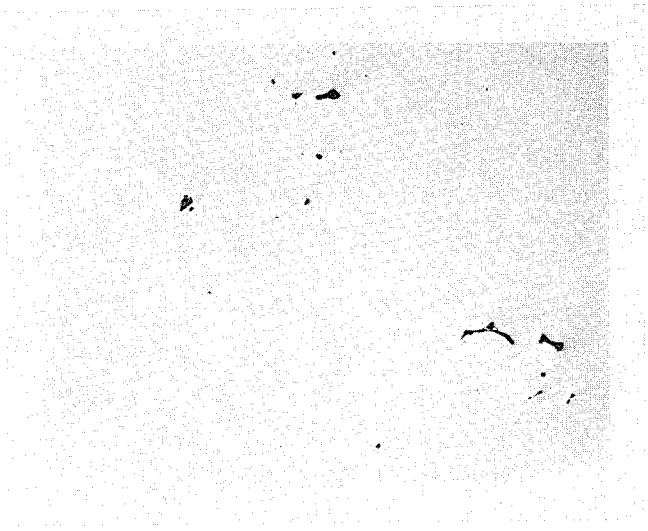
FIG. 4 is a photomicrograph at 100× magnification showing the microporosity structure of a cast preform of the present invention.

TABLE 1 illustrates stress data and other properties for 6 cast cold-forged samples;

TABLE 2 compares the property of cast iron material with that of final cast cold-forged samples;

TABLE 3 is a comparison of properties of 8 cast cold-forged samples; and

TABLE 4 is a comparison of the reduction in area to the surface hardness of 15 cast cold-forged samples.

DETAILED DESCRIPTION OF THE INVENTION

Although the present invention is believed suitable for forming any type of prosthesis device of a corrosion resistant austenitic stainless steel suitable for implantation in a physiological body, the invention is described in conjunction with a hip prosthesis formed of Type 316L stainless steel.

With reference to FIG. 1, a hip prosthesis is shown having a stem 10, collar 12 and ball 14. The stem 10, collar 12 and lower half 16 of the ball 14 are cast as a single piece. The upper half 18 of the ball is welded to the lower half 16 using conventional welding techniques. The ball 14 is designed to fit into a natural acetabulum. During surgery, the head of the original femur bone is removed and the entire stem 10 is inserted into the intermedullary canal of the bone. The stem includes a distal end 20 and a proximate end 21. The collar 12 is designed to rest on top of the calcar with the femur connected to the pelvis by inserting the ball 14 into the acetabulum.

The perform shown in FIG. 1 is cast using a conventional investment casting technique, also known as the "lost wax" method. Very briefly, the investment casting process as it applies to the present invention is as follows. Models of a stem 10, collar 12 and lower ball half 16 are made from wax using an injected pattern mold. Each model would include the stem, collar and lower ball half in unitary construction. Several of the wax models are then assembled in a cluster or "tree" arrangement and dipped into a ceramic slurry. The slurry may be a paste comprising a fine-grain refactory mold material and a bonding agent so that the wax mold becomes coated with this mixture. The ceramic mold is then fired in a furnace causing the wax models to melt. The result is a cast made of ceramic. The desired final material is then selected, which in the present case is preferably 316L austenitic stainless steel. This material is poured into the cast, allowed to cool and then broken. The individual preforms are then removed, sanded and cleaned. It will be obvious to one skilled in the art that other casting techniques may be used to provide a preform as described herein without departing from the spirit of the invention or scope of the claims.

The stem 10 is initially cast about 20 to 30 percent larger than the final size. Collar 12 and the lower half 16 of the ball are cast about 10 to 20 percent larger than the final size.

Referring to FIGS. 2*a* and 2*b*, the preform is then inserted in the lower die 24 of a hydraulic press. The lower die permits the side 22 of the stem 10 to contact one edge of the die. The top side 26 of the stem extends above the flat surface 28 of the lower die 24. An upper die 30 is then lowered compressing the stem, collar and lower half of the ball. The compressive force is exerted by a hydraulic press (not shown) or similar state-of-the-art compressing apparatus. By compressing the preform, it is forced to cold flow and fill the cavity of the cold-forging die at room temperature. This then results in the final desired shape and size. The cold-forging process and the equipment associated with the use of this procedure is well known to those skilled-in-the-art.

For purposes of the hip prosthesis as shown in FIG. 1, a load of between about 500 and 525 metric tons is used to compress the preform to its final shape and size.

The cold-forging step is repeated preferably at least one time and more preferably three times. This is done in order to overcome any major elastic recovery that could occur and assures the closing of any casting porosity that remained in the preform after the first compression.

Following the casting step, but before cold-forging, it may be desirable to solution anneal the preform to ensure that the carbides are in solution thus producing a part with maximal corrosion resistance. Solution annealing consists of heating the cast preform to approximately 2000° F. (1093° C.), holding that temperature for a sufficient time, followed by a quenching operation or very rapid cooling to room temperature. The holding time will depend on the size of the preform and alloy chemistry. If the cast part is very large and the carbon content very high, longer times are required for carbon and other elements to diffuse throughout the matrix of the element. For nominal size hip preforms as disclosed herein, 30 minutes to 1 hour should be sufficient to homogenize the carbon and other elements such as chromium and nickel. Homogenization is a smoothing out or uniform blending of the chemistry in the preforms. This step provides additional assurance of the best corrosion resistant condition for the hip preforms and eventual final hip prosthesis.

Following cold-forging, it is preferable to stress relieve the final cast cold-forged (CCF) endoprosthesis. This is accomplished by heat treating the endoprosthesis at 750° F. (399° C.) for two hours. The endoprosthesis is then allowed to cool to room temperature by ambient air cooling. Alternatively, the endoprosthesis may be cooled to room temperature by a quenching operation or rapid air cooling, techniques well known to those skilled in the art. This heat treatment relaxes the crystalline structure and relieves the residual stresses without interfering with the cold work.

Referring to FIGS. 3*a* and 3*b*, the final endoprosthesis is shown in solid lines in a horizontal view (FIG. 3*a*) and in a plan view (FIG. 3*b*). The dotted lines in FIGS. 3*a* and 3*b* show the shape of one side of the preform.

Referring specifically to FIG. 3*a*, the width W of the stem is narrower than the final dimension. This is done in order to provide space for the growth of the form within the lower die when compressed since the height H (see FIG. 3*b*) is larger in the preform than in the final endoprosthesis. As the height or thickness of the stem is reduced, it is necessary that the die permit the growth of the stem in a horizontal view as shown in FIG. 3*a*. However, since cold-forging by definition requires the reorganization of the crystalline structure resulting in a reduction in the porosity and, hence, higher strength of the material, the cross-sectional areas of the stem of the preform and of the endoprosthesis are not the same. In other words, the reduction in the area as a result of reducing the thickness or height of the stem is less than the increased area permitted by the growth of the stem along its width. Similarly, the collar and lower half of the ball are also compressed within the cold-forging die. In the case of the collar and lower ball half, however, reshaping is not generally permitted since overall compression is approximately 10% and is uniformly applied about the entire surfaces of the collar and lower ball half.

Referring to FIG. 4, shown is an optical microscope photomicrograph of a Type 316L austenitic stainless steel following investment casting only. Shown are large areas of porosity which can inhibit the strength characteristics of the material leading to premature failure. It is preferable to minimize the amount of porosity within a material since the presence of such can substantially affect the overall integrity of the material, particularly its ultimate tensile and yield strength.

Figure 5:
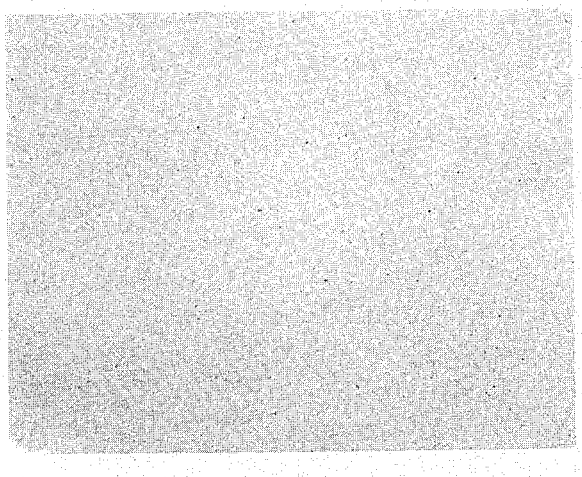
FIG. 5 is a photomicrograph at the same magnification as FIG. 4 showing the microporosity of the finished product after a first cold-forging step performed in accordance with the present invention.

Referring now to FIG. 5, shown is another optical microscope photomicrograph of a sample of 316L austenitic stainless steel but following the cold-forging step as described above. The starting material was cast oversized using the investment casting technique. As evident, the larger areas of porosity previously seen in FIG. 4 have been dissipated and only visibly now are uniformly distributed smaller areas of porosity which corresponding result in higher ultimate tensile strength and yield strength of the final materials. This is evident by referring to the following data.

The TABLE 1 below illustrates the improved strength characteristics of six cast cold-forged samples. Here again, the starting material was 316L austenitic stainless steel cast in accordance with the investment casting technique. The average value for the ultimate tensile stress is 102.9 ksi. The average yield stress is 85.8 ksi. Also shown in TABLE 1 is the corresponding elongation of each specimen indicating an adequate amount of ductility in the material. These samples were also stress relieved at 750° F. (399° C.) for two hours.

TABLE 1

Strength Data for 6 Cast Cold-Forged (CCF) Samples Compared with ASTM Requirements

| Sample Identification | Ultimate Tensile Stress (ksi) | Yield Stress (ksi) | Elongation (%) | Reduction In Area (%) |
|---|---|---|---|---|
| 6-2 | 105.0 | 84.9 | 21 | 48 |
| 6-5 | 104.0 | 89.3 | 15 | 31 |
| 6-6 | 104.0 | 87.8 | 15 | 30 |
| 7-4 | 105.0 | 87.2 | 17 | 31 |
| 7-5 | 99.6 | 83.0 | 12 | 29 |
| 7-8 | 99.6 | 82.4 | 21 | 48 |
| Average Values | (102.9) | (85.8) | (17) | (36) |

Referring to TABLE 2 below, the average values given in TABLE 1 are compared with the properties of as-cast 316L austenitic stainless steel samples (i.e. not cold-forged). As shown, four samples were tested for their ultimate tensile stress and yield stress. Line 5 of Table 2 are the "average values" from TABLE 1. Comparing the average values with the data from samples 6M and 7M, (which are selected because they are from the same casting lot in both cases), a 44% increase is shown in the ultimate tensile stress using the present invention and a 138% is shown in the yield stress.

In other words, there has been a substantial improvement in the strength characteristics of the material using the cold-forging process on oversized cast preforms.

TABLE 2

| Sample Identification | Ultimate Tensile Stress (ksi) | Yield Stress (ksi) | Elongation (%) | Reduction In Area (%) |
|---|---|---|---|---|
| 6M (As Cast) | 71.4 | 36.0 | 40 | 68.9 |
| 6S (As Cast) | 73.5 | 35.3 | 49 | 58 |
| 7M (As Cast) | 71.4 | 36.0 | 40 | 68.9 |
| 7S (As Cast) | 67.5 | 31.9 | 56 | 67 |
| Nos. 6 and 7 (After Forging, Avg. from Table 1) | 102.9 | 85.8 | 17 | 36 |
| Percent Change (Based on Samples 6M and 7M) | +44 | +138 | −57.5 | −47.8 |

TABLE 3 is a comparison of certain properties of eight other cast cold-forged samples. Illustrated for comparison are the ultimate tensile stress and the yield tensile stress corresponding with hardness measuring using the Rockwell Hardness testing standard, well known to those skilled-in-the-art. Historically, the Rockwell B and C scales are the most commonly used. The B scale is used for softer materials and the C scale is used for harder materials.

TABLE 3

Comparison of Properties of 8 CCF Samples

| Sample Identification | Ultimate Tensile Stress (ksi) | Yield Stress (ksi) | Elongation (%) | Reduction In Area (%) | Reduction In Diameter (%) | Rockwell Hardness Rc ($R_B$) |
|---|---|---|---|---|---|---|
| 7 | 102 | 67.3 | 32 | 65 | 27.5 | (100) |
| 8 | 93.3 | 89 | 20 | 58 | 38 | 27.5 |
| 14 | 125 | 113 | 13 | 45 | 48.2 | 30.4 |
| 12 | 143 | 131 | 11 | 47 | 57.6 | 32.5 |
| 13 | 137 | 122 | 11 | 40 | 57.6 | 36.5 |
| 9 | 164 | 150 | 7 | 30 | 60 | 37.7 |
| 10 | 156 | 148 | 6 | 25 | 60 | 38.2 |
| 11 | 136 | 129 | 14 | 34 | 62.3 | 35.7 |

Hardness is measured because there is a direct correlation between hardness and the strength of the material. That is, the harder the material the stronger it is. Accordingly, a hardness reading is another indication of the strength of the specimens and the quick way to compare, relatively, the strength of two specimens without the need of performing more sophisticated tensile tests.

Referring to TABLE 3 above, the last column indicates the Rockwell hardness using the Rockwell C or Rockwell B scale. As anticipated, as the ultimate tensile stress and the yield stress of the various samples increases, their surface hardness also increases. This confirms the correlation between hardness and strength mentioned above. Referring to Table 4, this comparison is applied. A total of 15 samples are shown in TABLE 4, 14 of which have hardness data. Based on an analogy between hardness and strength, this Table illustrates that as the diameter is reduced by cold forging, the hardness increases (or the strength of the sample increases). This is consistent with the mechanical properties of alloys. TABLE 4 also illustrates the effect of stress relieving. Certain samples as indicated in column 4 have been stress relieved. Substantial increases in the hardness are noted following stress relieving. As expected, such an increase in hardness corresponds with anticipated increases in strengths which further illustrates the anticipated enhanced performance of an endoprosthesis stress relieved following cold-forging.

TABLE 4

Comparison of Reduction in Diameter to Surface Hardness Of 15 CCF Samples

| Sample Identification | Reduction In Diameter (%) | Rockwell Hardness Rc | Stress Relieved | Hardness After Stress Relieved |
|---|---|---|---|---|
| 17 | 10.0 | N/A | | |
| 16 | 14.8 | 9 | | |
| 15 | 17.7 | 12-17 | | |
| 7 | 27.5 | 22-26 | X | 29-32 |
| 8 | 38.0 | 22-26 | X | 31-37 |
| 14 | 48.2 | 22-26 | X | 27-30 |
| 12 & 13 | 57.6 | 26-30 | X, X | 34-36 |
| 9 & 10 | 60.0 | 24½-26 | X, X | 34-36 |
| 11 | 62.3 | 27½ | X | 36-37 |
| 2 | 70.5 | 33 | | |
| 4 | 72.7 | 36 | | |
| 3 | 73.7 | 33 | | |
| 1 | 74.8 | 33½ | | |

FIG. 6 is a graph of tensile and yield stresses versus percent reduction in the diameter. Plotted are the ultimate tensile stress versus percent reduction in the diameter (symbol "X") of the eight samples shown in Table 3. Similarly, plotted are the yield stress versus percent reduction in the diameter (symbol "O") of the eight samples shown in Table 3. FIG. 6 is a graphical representation of the substantial increases in the strength characteristics of a cold-forged cast 316L austenitic stainless steel samples based on percent reduction in diameter by cold-forging.

FIG. 7 is a plot of stress (S) versus cycles to failure (N) which illustrates the corrosion fatigue characteristics of an endoprosthesis manufactured in accordance with the present invention. Since a person's body fluids are corrosive, fatigue strength determined in a corrosive environment is important. To test the present invention in such an environment, fatigue testing samples were produced from the distal ends 20 of stems 10. These stems were cyclically loaded in a three-point bend mode as shown schematically in FIG. 7 in a saline solution. The ratio of the minimum tested stress to the maximum tested stress yields an R value for any fatigue testing. In this experiment, all the samples were tested at $R=0.1$ The stress at which samples do not break following $1\times10^7$ cycles of loading is considered the fatigue strength or endurance limit of the material. $1\times10^7$ cycles is believed to represent a life of about ten years in an average patient assuming that the average patient who needs a hip endoprosthesis take about one million steps a year. To ensure that the corrosive solution would have an opportunity to affect the life of the test samples, the cyclic loads were induced at a frequency of five hertz. With such a loading pattern, it took over 23 days to cycle a sample $1\times10^7$ cycles.

For the endoprosthesis stems manufactured in accordance with the present invention, the corrosion fatigue strength is approximately 60 ksi. This value is substantially higher than reported results for cold-worked wrought 316 L stainless steel (40 ksi) and cast cobalt chromium alloy (40 ksi) even recognizing that such prior reported results were obtained using a cyclic loading pattern of 30 hertz and the test configuration was a variation from the three-point bend mode model shown in FIG. 7.

The foregoing disclosure and description of the invention are illustrative and exemplary. Changes in the size, shape and materials, as well as the details of the illustrated construction may be made without departing from the spirit of the invention, all of which are contemplated as falling within the scope of the claims of the invention.

We claim:

1. A medical prosthesis formed as a result of a method comprising the steps of:

casting an oversized preform substantially in the same configuration of the medical prosthesis to be formed, from a corrosion resistant, austenitic, stainless steel; and cold-forging the preform in a closed die having cavities that correspond in shape to but are smaller than the preform, to reduce the overall dimensions of the preform to a final finished size defined by the cavity, and to strengthen the preform.

2. The medical prosthesis of claim 1 wherein said preform is cast with at least a portion of said preform being between about 20 and 30 percent larger than its final size.

3. The medical prosthesis of claim 2 wherein the remaining portion of said preform as cast being between about 10 and 20 percent larger than its final size.

4. The medical prosthesis of claim 1 wherein said cold-forging step comprises compressing said preform at least one time.

5. The medical prosthesis of claim 4 wherein said cold-forging step comprises compressing said preform at least three times.

6. The medical prosthesis of claim 1 further comprising the step of stress relieving the preform wherein the stress relieving step includes:

heating the preform to a temperature of about 750° F. (399° C.); and maintaining the preform at said temperature for aout two hours, followed by cooling to room temperature.

7. The medical prosthesis of claim 1 further comprising the step of solution annealing the preform following said casting step but prior to said cold-forging step.

8. The medical prosthesis of claim 7 wherein said solution annealing step comprises:

heating the preform to a temperature of about 2000° F. (1093° C.); and maintaining the preform at said temperature for at least one-half hour, followed by rapid cooling to room temperature.

9. The medical prosthesis of claim 1 wherein said medical prosthesis is a hip prosthesis.

10. The medical prosthesis of claim 9 wherein said corrosion resistant austenitic stainless steel is Type 316L stainless steel.

11. The medical prosthesis of claim 10 wherein said cold-forging step includes applying a force between about 500 metric tons and 525 metric tons.

12. A method of manufacturing a medical prosthesis comprising the step of:

casting an oversized preform from austenitic stainless steel; and cold-forging the preform in closed dies to reduce the overall dimension of the preform to finished size and to strengthen the preform.

13. The method of claim 12 further comprising the step of stress relieving the preform wherein the stress relieving step includes:

heating the preform to a temperature of about 750° F. (399° C.); and maintaining the preform at said temperature for about two hours, followed by cooling to room temperature.

14. The method of claim 12 further comprising the step of solution annealing the preform following said casting step but prior to said cold-forging step.

15. The method of claim 14 wherein said solution annealing step comprises:

heating the preform to a temperature of about 2000° F. (1093° C.); and maintaining the preform at said temperature for at least one-half hour, followed by rapid cooling to room temperature.

16. The method of claim 12 wherein said medical prosthesis is a hip prosthesis.

17. The method of claim 16 wherein said corrosion resistant austenitic stainless steel is Type 316L stainless steel.

18. The method of claim 12 wherein said cold-forging step comprises compressing said preform at least one time.

19. The method of claim 18 wherein said cold-forging step comprises compressing said preform at least three times.

20. The method of claim 12 wherein said preform is cast with at least a portion of said preform being between about 20 and 30 percent larger than its final size.

21. The method of claim 20 wherein the remaining portion of said perform as cast being between about 10 and 20 percent larger than its final size.

* * * * *